US006050667A

United States Patent [19]

Yamada

[11] Patent Number: 6,050,667

[45] Date of Patent: Apr. 18, 2000

[54] INK CARTRIDGE HOLDING DEVICE HAVING CAP-COVERED SWITCH

[75] Inventor: Noriyuki Yamada, Tsushima, Japan

[73] Assignee: Brother Kogyo Kabushiki Kaisha, Nagoya, Japan

[21] Appl. No.: 09/036,785

[22] Filed: Mar. 9, 1998

[30] Foreign Application Priority Data

Mar. 11, 1997 [JP] Japan ..... 9-056508

[51] Int. Cl.[7] ..... B41J 29/393

[52] U.S. Cl. ..... 347/19; 347/86

[58] Field of Search ..... 347/19, 40, 43, 347/49, 50, 86, 87; 200/302.1, 302.2, 302.3

[56] References Cited

U.S. PATENT DOCUMENTS 4,277,791 7/1981 Rosenstock et al. ..... 347/86
5,489,754 2/1996 Dirmeyer et al. ..... 200/302.1
5,671,840 9/1997 Glicksman ..... 200/302.3
5,788,059 8/1998 Jahangiri ..... 200/302.3

*Primary Examiner*—Matthew S. Smith
*Assistant Examiner*—Hoan Tran
*Attorney, Agent, or Firm*—Oliff & Berridge, PLC

[57] ABSTRACT

An image printing apparatus has an ink cartridge detector device for detecting ink cartridges on a carriage. The detector device includes switches to be actuated by the ink cartridges. A protective cover having water-proof type elastic caps covers the switches to restrict ink having leaked from the ink cartridges from entering into the switches. The protective cover has an air vent which facilitates a deformation of the cap at the time of attachment of the ink cartridge to the carriage. The protective cover further has an absorbing member for absorbing the ink and a wall for restricting the ink from reaching to electric circuit parts provided near the switch.

20 Claims, 3 Drawing Sheets

INK CARTRIDGE HOLDING DEVICE HAVING CAP-COVERED SWITCH

CROSS REFERENCE TO RELATED APPLICATION

This application relates to and incorporates herein by reference Japanese Patent Application No. 9-56508 filed on Mar. 11, 1997.

BACKGROUND OF THE INVENTION

1. Field of the Invention

The present invention relates to an ink cartridge holding device for use in an image printing apparatus and, more particularly, to an ink cartridge holding device having an ink cartridge detector for detecting an ink cartridge mounted on a carriage which carries a printer head for printing operation.

2. Related Art

A conventional image printing apparatus has an ink cartridge detecting device for detecting that an ink cartridge is mounted on a carriage. The detecting device includes a switch positioned to face the ink cartridge on the carriage so that the switch is turned on or off by the ink cartridge. Thus existence/absence (attachment/detachment to/from the carriage) of the ink cartridge is detected in response to the on/off signal from the switch.

According to the conventional ink cartridge holding device, ink is likely to leak from the ink cartridge through an ink supply inlet to the outside when the ink cartridge is detached for replacement. The ink thus leaked may possibly cause erroneous switching (short-circuiting) between the fixed contact and the movable contact of the detection switch when it enters into the detection switch. Further, ink mist tends to remain around the carriage when the printing operation continues for a long period of time, thus causing the erroneous switching operation of the detection switch. Those ink will also cause erroneous operations of other electronic circuit parts mounted on the carriage together with the detection switch.

SUMMARY OF THE INVENTION

It is therefore an object of the present invention to provide an ink cartridge holding device which, even when ink leaks or ink mist remains, reduces erroneous operation of an electronic circuit parts mounted in the vicinity of the ink cartridge.

It is a further object of the present invention to provide an ink cartridge holding device which restricts ink leaking from an ink cartridge or ink mist from entering into a detector unit provided for detecting the ink cartridge on a carriage.

According to the present invention, a protective cover unit is provided to cover a detector in an ink cartridge holding device and restricts entrance of ink leaking from an ink cartridge or ink mist remaining around the ink cartridge. The protective cover unit allows an ink cartridge to actuate the detector when the ink cartridge is attached to a carriage.

Preferably, the protective cover unit has a water-proof type elastically deformable cap and the detector is comprised of an on/off-type switch. The protective cover unit has a vent hole or groove to vent inside air to the outside by an elastic deformation caused at the time of attaching the ink cartridge to the carriage. The air in the cap does not resist against deformation of the cap thereby facilitating a smooth actuation of the switch by the ink cartridge.

Preferably, the protective cover unit has an absorbing member to absorb the ink having leaked from the ink cartridge. The absorbing material thus restricts the ink from entering into the detector.

Preferably, the detector is disposed on an electric circuit board mounted on the carriage. Further, the protective cover unit has a wall to restrict the ink from reaching to an electric contact disposed on the circuit board electrically connectable to a printing head-side contact.

BRIEF DESCRIPTION OF THE DRAWINGS

Other objects, features and advantages of the present invention will be made more apparent by the following detailed description with reference to the accompanying drawings. In the accompanying drawings.

DETAILED DESCRIPTION OF THE PREFERRED EMBODIMENT

Figure 1:
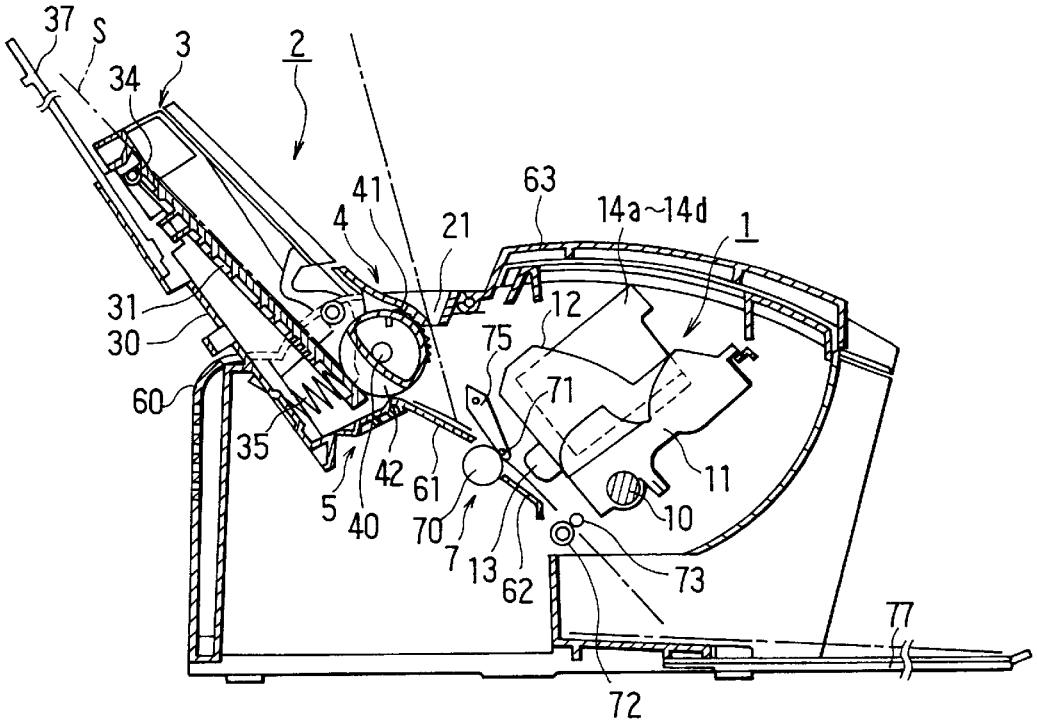
FIG. 1 is a sectional side view showing an image printing apparatus having an ink cartridge holding device according to an embodiment of the present invention.
Figure 5:
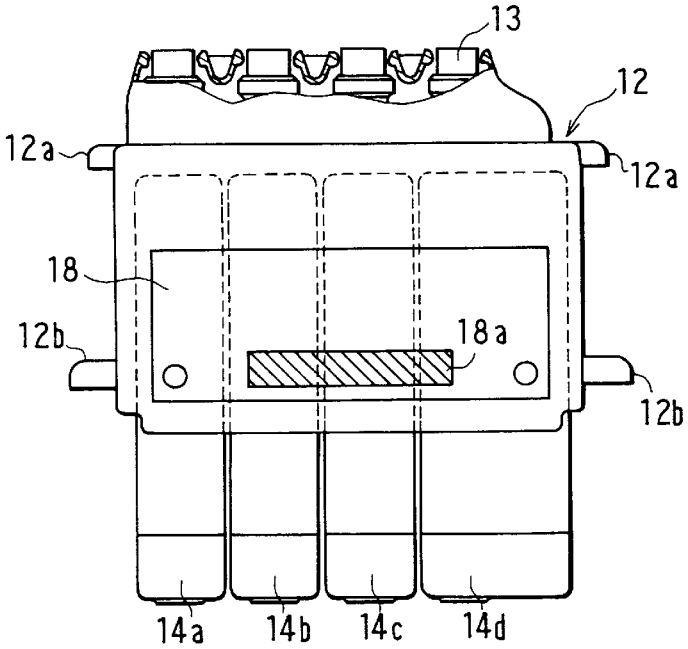
FIG. 5 is a bottom view showing a head unit used in the image printing apparatus shown in FIG. 1.

An image printing apparatus has, as shown in FIG. 1, an ink-jetting type printer unit 1, a paper holder unit 2 and a paper feeder unit 7 so that papers S are fed sheet by sheet by from the holder unit 2 to the front side of the printer unit 1 by the feeder unit 7.

The printer unit 1 comprises a carriage 11 supported on a guide rail 10 reciprocally movably and a head unit 12 mounted on the carriage 11. The head unit 12 has a printer head 13 for jetting ink onto the paper S and holds thereon four ink cartridges 14*a*, 14*b*, 14*c* and 14*d* for supplying four colored inks (cyan, magenta, yellow and black) to the printer head 13 respectively. Each ink in the ink cartridges 14*a*–14*d* is a water-based ink including a dye as disclosed in the copending patent application Ser. No. 08/824,516 filed on Mar. 26, 1997 which is incorporated herein by reference. The guide rail 10 extends transversely, that is, in the width direction of the paper S in parallel relation with the paper surface and in perpendicular relation with the paper feeding direction.

The paper feeder unit 2 comprises a hopper 3 for storing the papers S therein, a feeder mechanism 4 for feeding the papers S from the hopper 3 and a stopper wall 5 for holding the papers S to be fed out by the feeder unit 4. Inside the hopper 3, a support plate 31 for supporting the stack of papers S thereon. The support plate 31 is held pivotally movably around a shaft 34 and normally biased upward by a spring 35. The feeder mechanism 4 comprises a support shaft 40 provided in parallel with the width direction of the paper S and a roller 41 attached around the support shaft 40.

A slit opening 21 is provided between the feeder unit 4 and a cover 63 which defines the outer confines of the printing apparatus, so that the paper S may be manually slid therethrough. The slit opening 21 is located at the downstream of the feeder unit 4 and at the upstream of a paper feeder unit 7.

The paper feeder unit 7 comprises a pair of rollers 70 and 71 disposed upstream of the printer head 13 for feeding the papers therethrough, a lever 75 for supporting the roller 71, a pair of rollers 72 and 73 disposed downstream of the printer head 13 for discharging the image-printed papers S and passage walls 61 and 62 defining a paper moving passage. The passage walls 61 and 62 are formed as a part of the hopper 3, feeder unit 4 and frame 60 and extends continuously from the stopper wall 5 toward the position facing the printer head 13.

Figure 2:
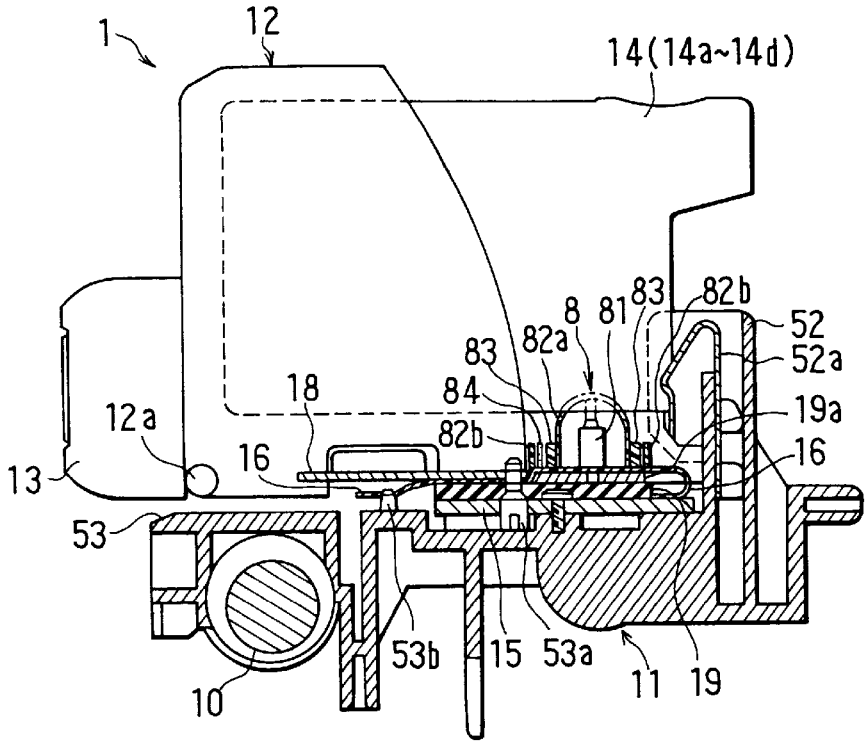
FIG. 2 is a sectional side view showing the internal structure of a printing mechanism used in the image printing apparatus shown in FIG. 1.
Figure 3:
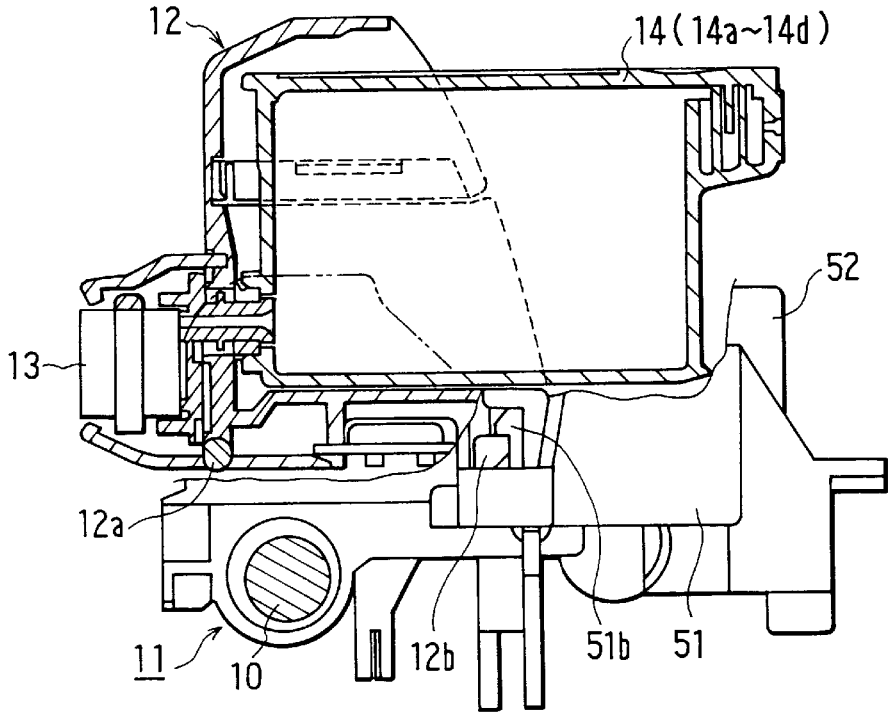
FIG. 3 is a side view showing partly in section the printing mechanism shown in FIG. 2.
Figure 4:
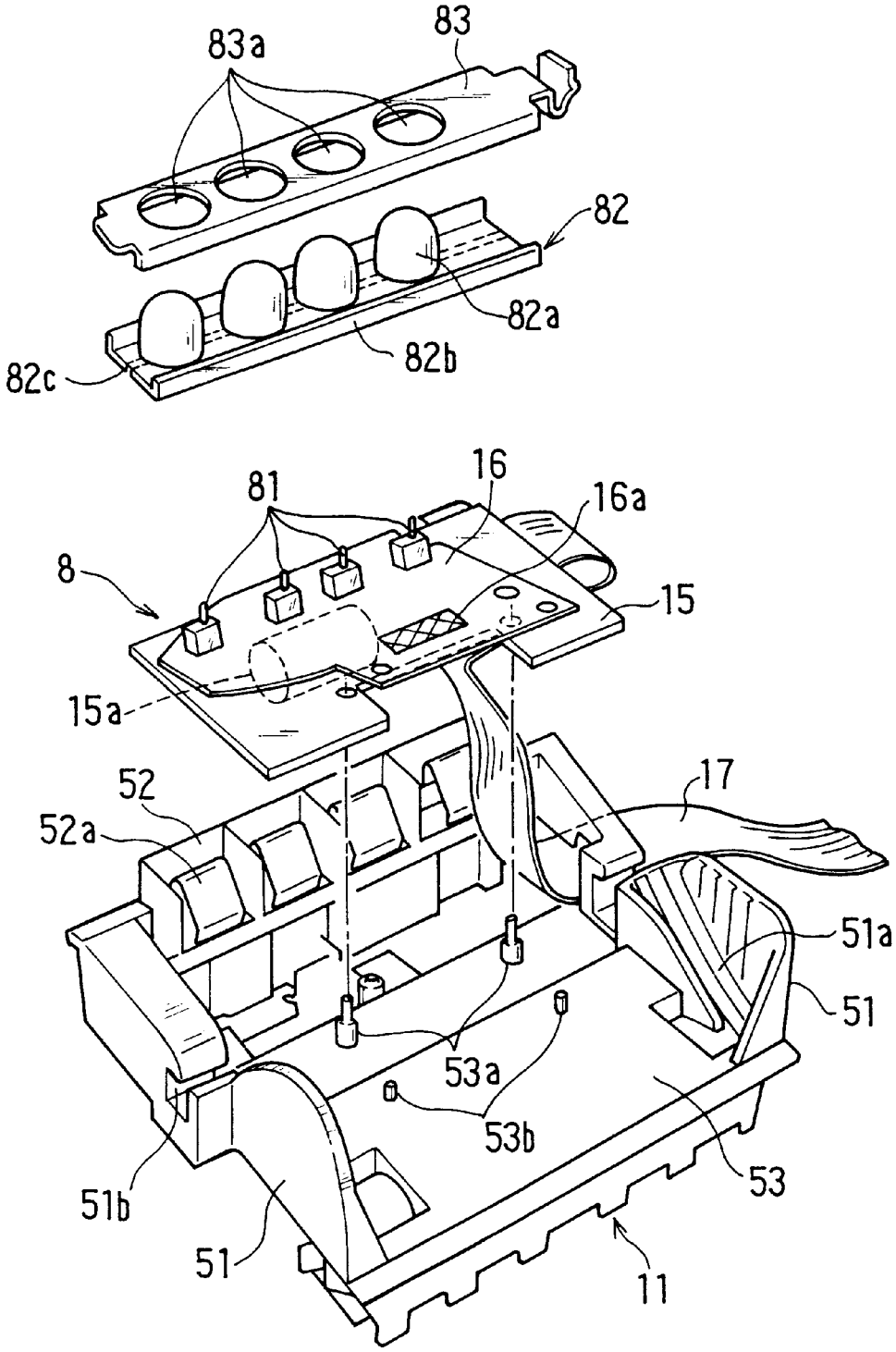
FIG. 4 is an exploded perspective view showing a carriage used in the image printing apparatus shown in FIG. 1.

As understood from FIGS. 2, 3 and 4 in detail, the carriage 11 has a groove 51*a* and a locking hook 51*b* on each lateral side wall 51 to hold the head unit 12 and the ink cartridge 14 fixedly thereon. Metal plate springs 52*a* are placed in front of the rear side wall 52 of the carriage 11 to forwardly press and lock in position the ink cartridge 14. The head unit 12 has protrusions 12*a* and 12*b* on its both lateral sides. The protrusion 12*a* is engaged with the groove 51*a* while the protrusion 12*b* is engaged with the hook 51*b*, thereby to lock the head unit 12 on the carriage 11. A carriage base plate 15 is fixed on the bottom 53 of the carriage 11, and a flexible printed circuit board (FPC) 16 is mounted on the carriage base plate 15. The carriage base plate 15 holds thereon electronic parts such as a capacitor 15 and is connected electrically to a flexible harness 17 which transmits control signals from an electronic control circuit (not shown) to the printer head 13. The carriage base plate 15 is held in position by protrusions 53a formed on the bottom 53 of the carriage 11.

The FPC 16 is electrically connected at one end thereof to the electric wiring of the carriage base plate 15, turned in midway and held in position at the other end thereof by protrusions 53*b* formed on the bottom of the carriage 11. An elastic rubber plate 19 and a reinforcing plate 19*a* are disposed between the turned part of FPC 16 and the carriage base plate 15. The FPC 16 holds a detection switch unit 8 fixedly thereon for detecting existence/absence (attachment/detachment) of the ink cartridge 14 on the carriage 11. Dimple type carriage-side contacts 16*a* are formed on the FPC 16 thereby to transmit printing instruction signals and like signals to the head unit 12. The elastic rubber plate 19 disposed underside of the contacts 16*a* has protrusions extending upward and biasing corresponding contacts 16*a* upward.

The head unit 12 has a head base plate 18 at the side which faces the carriage 11. The head base plate 18 is formed with head-side contacts 18*a* so that both contacts 16*a* and 18*a* contact each other to provide an electric connection therebetween as long as the head unit 12 is attached to the carriage 11. The protrusions on the elastic rubber plate 19 keeps pressing up the contacts 16*a*, thus assuring the contacting force between the contacts 16*a* and 18*a*.

The cartridge detection unit 8 has four on/off type switches 81 mounted on the head-side base plate 15 as shown in FIG. 4 and having fixed contacts and movable contacts. Each switch 81, with its movable contact being pressed down to contact its fixed contact, turns on to produce an ON signal to the control circuit when the corresponding ink cartridge 14 (14*a*–14*d*) is attached to the carriage 11 as shown in FIG. 2. The carriage detection unit 8 further has a protective cover 82 having four water-proof type silicone rubber caps 82*a* which cover the switches 81 liquid-tightly. The protective cover 82 is formed with a pair of side walls 82*b* rising from its base part and extending longitudinally, that is, in the direction the four caps 82*a* are aligned. The protective cover 82 is further formed with a longitudinal groove 82*c* at the underside of the base part thereby to vent the air or to lower the pressure within the cap 82*a*. This groove 82*c* allows the air in each cap 82*a* to be vented even under the condition that the FPC 16 is fixed to the base plate 15 air-tightly through the elastic rubber plate 19. The groove 82*c* may be replaced by a hole. A switch holder 83 having four openings 83*a* is placed on the protective cover 82 to hold the caps 82*a* in place. The caps 82*a* pass through the corresponding openings 83*a*. As shown in FIG. 2, absorbing members 84 like felt material are placed on the switch holder 83 longitudinally along the walls 82*b* between the caps 82*a* and the walls 82*b* to absorb the ink which will leak from the ink cartridge 14 at the time of its attachment/detachment.

In the above embodiment, as the water-proof type protective cover 82 is placed over the detection switches 81, it protects the detection switches 81 from operating erroneously due to short-circuiting between the fixed parts and the movable parts which may be caused by the ink having leaked from the ink cartridge 14 at the time of replacement or by the ink mist accumulating in and around the head unit 12. When the ink cartridge 14 is mounted on the carriage 11, the caps 82*a* are pressed down and elastically deform to vent the air inside the caps 82*a* through the groove 82*c*. This deformation enables smooth actuation of the switches 81 by the cartridge 14 therethrough. As the absorbing members 84 are placed adjacent to the detection switches 81, the ink having leaked from the ink cartridge 14 or the ink mist remaining around the detection switches 81 is restricted from entering into the detection switches 81. Further, as the protective cover 82 has rising walls 82*b* on both sides of the caps 82*a*, the ink having leaked from the ink cartridge 14 is restricted from flowing out from the protective cover 82. Thus short-circuiting in a surrounding electric circuit including switches, which will be caused otherwise by the ink leakage, is reduced to a minimum as well.

In the above embodiment, arrangement of the detection switches 81 as well as constructions of the carriage-side contacts 16*a* and the head unit-side contacts 18 can be modified as the case may be. For example, other pressure or load-responsive member may be used for detecting the presence/absence of the ink cartridges 14 in place of the on/off type switches 81 and may be placed on other than the bottom of the carriage 11. The protective cover 82 may be constructed to cover an entirety of the FPC 16 to protect all the entire electronic circuit parts on the FPC 16.

The present invention should not be limited to the disclosed embodiment and its modifications but may be altered further without departing from the spirit and scope of the invention.

I claim:

1. A device for holding an ink cartridge in an image printing apparatus, the device comprising:

a carriage for detachably holding the ink cartridge thereon;

a printer head supported on the carriage for jetting ink supplied from the ink cartridge for image printing;

a switch actuatable by the ink cartridge for detecting a presence/absence of the ink cartridge on the carriage; and a protective cover having an elastic cap for covering the switch to protect the switch from the ink and ink mist, the protective cover being deformable to enable the ink cartridge to actuate the switch therethrough, the elastic cap being a water-proof type, and the protective cover having an air vent which communicates an inside and outside of the cap for venting air in the inside to the outside when the protective cover is deformed by the ink cartridge.

2. The device of claim 1, wherein:

the protective cover has an absorbing member disposed to surround the cap for absorbing the ink and ink mist existing therearound.

3. The device of claim 2, wherein:

the switch is mounted on a base plate fixedly held on the carriage;

the base plate has a contact provided in the vicinity of the switch for an electric connection with a contact of the printer head; and the protective cover has a wall at a position between the cap and the contact on the base plate for restricting the ink having leaked from the ink cartridge from reaching to the contact on the base plate.

4. The device of claim 1, wherein:

the switch is mounted on a base plate fixedly held on the carriage;

the base plate has a contact provided in the vicinity of the switch for an electric connection with a contact of the printer head; and the protective cover has a wall at a position between the cap and the contact on the base plate for restricting the ink having leaked from the ink cartridge from reaching to the contact on the base plate.

5. A device for holding an ink cartridge in an image printing apparatus, the device comprising:

a carriage for detachably holding the ink cartridge thereon;

a printer head supported on the carriage for jetting ink supplied from the ink cartridge for image printing;

a switch actuatable by the ink cartridge for detecting a presence/absence of the ink cartridge on the carriage; and a protective cover having an elastic cap for covering the switch to protect the switch from the ink and ink mist, the protective cover being deformable to enable the ink cartridge to actuate the switch therethrough, the protective cover having an absorbing member for absorbing the ink and ink mist existing therearound.

6. The device of claim 5, wherein:

the absorbing member is disposed outside of the cap;

the switch is mounted on a base plate fixedly held on the carriage;

the base plate has a contact provided in the vicinity of the switch for an electric connection with a contact of the printer head; and the protective cover has a wall at a position between the absorbing member and the contact on the base plate for restricting the ink having leaked from the ink cartridge from reaching to the contact on the base plate.

7. A device for holding an ink cartridge in an image printing apparatus, the device comprising:

a carriage for detachably holding the ink cartridge thereon;

a printer head supported on the carriage for jetting ink supplied from the ink cartridge for image printing;

a switch actuatable by the ink cartridge for detecting a presence/absence of the ink cartridge on the carriage; and a protective cover having an elastic cap for covering the switch to protect the switch from the ink and ink mist, the protective cover being deformable to enable the ink cartridge to actuate the switch therethrough, the switch being mounted on a base plate fixedly held on the carriage, the base plate having a contact thereon for an electric connection with a contract of the printer head, and the protective cover having a wall for restricting the ink having leaked from the ink cartridge from reaching to the contact on the base plate.

8. A device for holding an ink cartridge in an image printing apparatus, the device comprising:

carriage means for holding the ink cartridge thereon for jetting ink;

electric circuit means disposed adjacent to and operatively with the carriage means;

cover means covering the circuit means to restrict the ink from entering into the circuit means, the circuit means including an electric circuit board and an electric detector disposed on the circuit board to be actuated by the ink cartridge through the cover means, and the cover means including a water-proof type elastic cap for fluid-tightly covering the detector; and absorbing means disposed outside of the cap for absorbing the ink from the ink cartridge.

9. The device of claim 8 further comprising:

holder means having an opening for the elastic cap and holding the cover means tightly in position.

10. The device of claim 8, further comprising:

vent means for communicating an inside and outside of the cap to vent air in the inside to the outside when the cap is deformed by the ink cartridge.

11. The device of claim 10, further comprising:

elastic plate means for elastically supporting the circuit board at a side opposite to the cover means.

12. The device of claim 10, wherein:

the cover means includes a wall disposed between the cap and the electric parts supported on the electric circuit board to restrict the ink having leaked from the ink cartridge from reaching to the electric parts.

13. A device for holding an ink cartridge in an image printing apparatus, the device comprising:

carriage means for holding the ink cartridge thereon for jetting ink;

electric circuit means disposed adjacent to and operatively with the carriage means;

cover means covering the circuit means to restrict the ink from entering into the circuit means, the circuit means including an electric circuit board and an electric detector disposed on the circuit board to be actuated by the ink cartridge through the cover means, and the cover means including a water-proof type elastic cap for fluid-tightly covering the detector; and vent means for communicating an inside and outside of the cap to vent air in the inside to the outside when the cap is deformed by the ink cartridge.

14. A device for holding an ink cartridge in an image printing apparatus, the device comprising:

carriage means for holding the ink cartridge thereon for jetting ink;

electric circuit means disposed adjacent to and operatively with the carriage means; and cover means covering the circuit means to restrict the ink from entering into the circuit means, wherein:

the circuit means includes a circuit board supporting a cartridge detector and electric parts thereon; and a wall is provided between the cover means and the electric parts for restricting the ink from the ink cartridge from reaching to the electric parts.

15. The device of claim 14, wherein:

the cover means includes a water-proof type elastic cap for fluid-tightly covering the detector; and absorbing means is disposed outside of the cap for absorbing the ink having leaked from the ink cartridge.

16. The device of claim 14, wherein:

the circuit means is inclined in the printing apparatus;

the carriage detector is disposed on the circuit board at an elevated position; and the electric parts are disposed on the circuit board at a position lower than the elevated position.

17. A device for holding an ink cartridge in an image printing apparatus, the device comprising:

carriage means for holding the ink cartridge thereon for jetting ink;

electric circuit means disposed adjacent to and operatively with the carriage means; and cover means covering the circuit means to restrict the ink from entering into the circuit means, wherein:

the circuit means has a circuit board, a cartridge detector and electric parts, and is inclined in the printing apparatus;

the cartridge detector is disposed on the circuit board at an elevated position; and the electric parts are disposed on the circuit board at a position lower than the elevated position.

18. The device of claim 17, wherein:

the cover means includes a water-proof type elastic cap for fluid-tightly covering the cartridge detector.

19. The device of claim 18; further comprising:

absorbing means disposed outside of the cap for absorbing the ink having leaked from the ink cartridge.

20. The device of claim 18, further comprising:

vent means for communicating an inside and outside of the cap to vent air in the inside to the outside when the cap is deformed by the ink cartridge.

* * * * *